US005591008A

United States Patent [19]

Wrobel et al.

[11] Patent Number: 5,591,008

[45] Date of Patent: Jan. 7, 1997

[54] FAN IMPELLERS

[75] Inventors: Günter Wrobel, Villingen-Schwenningen; Wolfgang Engel, Königsfeld; Raimund Engelberger, St. Georgen, all of Germany

[73] Assignee: Papst-Motoren GmbH & Co., KG, St. Georgen, Germany

[21] Appl. No.: 459,796

[22] Filed: Jun. 2, 1995

Related U.S. Application Data

[63] Continuation of Ser. No. 787,409, Nov. 4, 1991, abandoned.

[51] Int. Cl.[6] ..... F04D 29/00

[52] U.S. Cl. ..... 416/144; 416/186 R

[58] Field of Search ..... 416/144, 186 R, 416/223 B

[56] References Cited

U.S. PATENT DOCUMENTS

| | | | |
|---|---|---|---|
| 1,436,369 | 12/1922 | Hazell | 416/144 |
| 2,336,597 | 12/1943 | Moeller | 416/144 |
| 2,573,875 | 11/1951 | Riddiford | 416/144 |
| 4,647,271 | 3/1987 | Nagai et al. | 416/186 R |
| 4,776,763 | 10/1988 | Light | 416/144 |
| 5,129,284 | 7/1992 | Brueckner et al. | 416/144 |

FOREIGN PATENT DOCUMENTS

| | | | |
|---|---|---|---|
| 2366469 | 6/1978 | France | 416/186 R |
| 2627344 | 12/1977 | Germany | 416/186 R |
| 30516 | 3/1979 | Japan | 416/144 |
| 211845 | 12/1983 | Japan | 416/144 |
| 290693 | 5/1953 | Switzerland | 416/144 |

*Primary Examiner*—John T. Kwon

[57] ABSTRACT

An impeller for a fan comprising a hub for rotation by a drive rotor and a plurality of fan blades for rotation with the hub, the impeller further comprising a support or guide member supporting or connecting fan blades of said plurality, and wherein one or more pockets are provided in said support or guide member and open axially of the fan for receiving balance weights.

20 Claims, 2 Drawing Sheets

FAN IMPELLERS

This is a continuation of application Ser. No. 07/787,409, filed Nov. 4, 1991, now abandoned.

BACKGROUND OF THE INVENTION

The present invention relates to an impeller for a blower, for example for a radial fan.

In radial fans, the air or the like is sucked in axially and blown out radially. Generally, the impellets of such fans are made from sheet metal. For example, a blade ring or rim is positioned between two guide rings and is connected thereto, for example, by bending over sheet metal tabs or by pinned fitting. If in the case of larger impeller diameters balancing of the impeller Is necessary, then balancing weights are fixed by clips to appropriate points of the impeller. It is also possible to balance the impeller by a planned milling away of parts of the impeller. Such techniques are also used with other types of blowers, for example, with axial-flow fans.

It is an object of the present invention to simplify the manufacture and balancing of impellers for fans, particularly for radial fans, end to cut down production costs.

SUMMARY OF THE PRESENT INVENTION

According to the present invention there is provided an impeller for a fan comprising a hub for rotation by a drive rotor and a plurality of fan blades for rotation with the hub, the impeller further comprising a support or guide member supporting or connecting fan blades of said plurality, and wherein one or more pockets are provided in said support or guide member and open axially of the fan for receiving balance weights.

In an embodiment, for a radial fan, said support or guide member is a guide ring arranged coaxially of said hub and supporting said plurality of fan blades.

For example, an impeller for a radial fan may have at least one of the guide rings provided with pockets. Preferably, said guide rings are arranged coaxially, and each is equipped with pockets, so as to permit complete dynamic balancing. The pockets may be in the form of axially open grooves, grooved sectors or bores.

In order to permit the insertion of balancing weights in simple manner on both guide or support rings without impediment by the other guide ring, both guide rings preferably have different diameters, the diameter steps being towards the open side of the pockets and the pockets of both guide rings being open to the same side. This makes it possible for the insertion of balancing weights from one side to not only take place without impediment on the front guide ring, but also on the larger diameter guide ring positioned behind it. However, it is also possible to construct the pockets so as to be open to both sides.

The impeller can be manufactured particularly inexpensively, if it comprises a plastics injection moulding, which encloses in one-piece manner the two guide rings and the interposed blade ring, as well as a sheet metal disk forming the hub and fixed to the plastics injection moulding by hot crimping of pins of the plastics part inserted in holes in the sheet metal disk. The one-piece injection moulding of this part is made particularly easy in that both guide rings have different diameters, which facilitates the design of the mould.

In a particularly advantageous development of the invention the pins for fixing to the sheet metal disk are located on lateral faces of the blades of the blade ring and the larger diameter guide ring is connected by connecting webs injection moulded onto the blades to the ends of the latter. This makes it possible to produce the plastics injection moulding with only two mould halves and without requiring slides. The sheet metal disk is preferably located within the associated guide ring and its inner face is aligned with the inner face of the guide ring.

BRIEF DESCRIPTION OF THE DRAWINGS

Embodiments of the present invention will hereinafter be described, by way of example, with reference to the accompanying drawings, in which.

DESCRIPTION OF PREFERRED EMBODIMENTS

Figure 1:
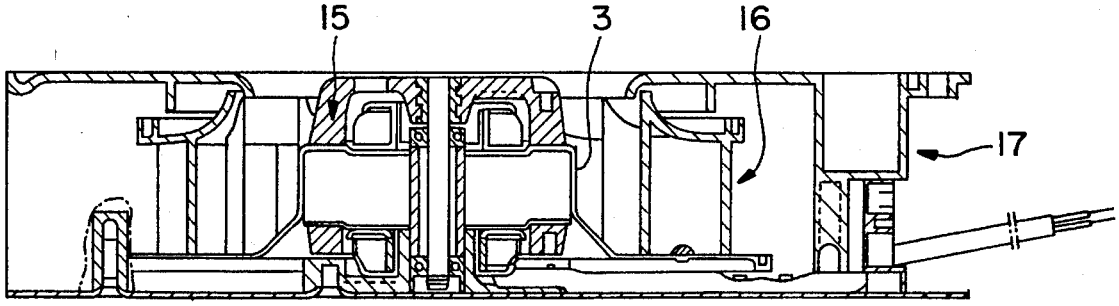
FIG. 1 shows a longitudinal section through a radial fan having an impeller of the invention.
Figure 2:
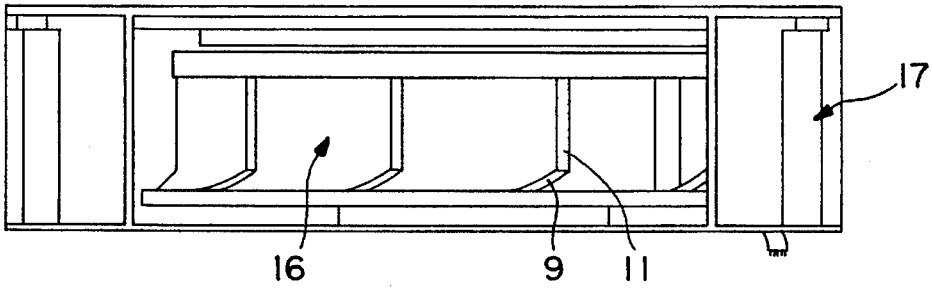
FIG. 2 shows a side view of the radial fan of FIG. 1.

The radial fan shown in FIG. 1 and 2 has a fan casing 17, an impeller 16 end a drive motor 15. In the illustrated embodiment, the drive motor 15 is constructed as an external rotor-type motor having a centrally arranged stator surrounded by an external rotor. A hub portion 3 of the impeller 16 is pressed onto the rotor or a rotor hub such that the impeller 16 rotates with the rotor. Upon rotation of the impeller 16, the radial fan is arranged to suck in air from above, as illustrated in FIGS. 1 and 2, and blow it out radially.

Figure 3:
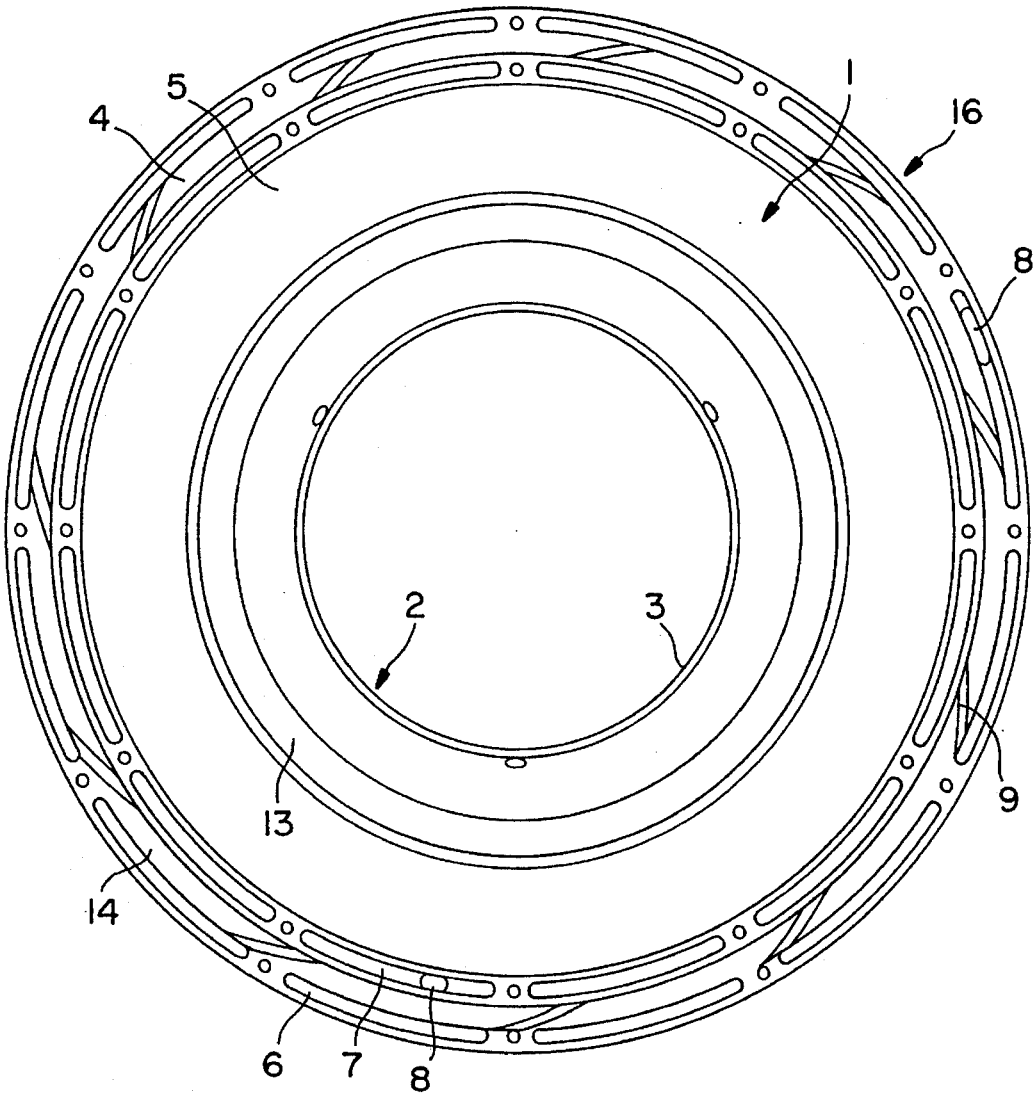
FIG. 3 is en end view of the impeller of the radial fan shown in FIGS. 1 and 2.

The impeller 16 of the radial fan is illustrated in FIGS. 3 end 4 and is made of two parts, namely a plastics injection moulding 1 and a sheet metal disk 2. The injection moulding 1 defines two axially spaced, substantially coaxial, Guide range 4 and 5 and a blade ring 10, having blades 11, disposed between said guide rings 4 and 5. On radially extending, axial ends of the blades 11, the plastics injection moulding 1 is provided with pins 12, which each extend through a corresponding bore an the sheet metal disk 2 and which are interconnected by hot crimping the two parts. Preferably, each blade 11 carries several radially spaced pins 12, which are fixed by hot crimping in corresponding bores of the sheet metal disk 2, so as to create a stable impeller and also avoid resonances and vibrations.

Figure 4:
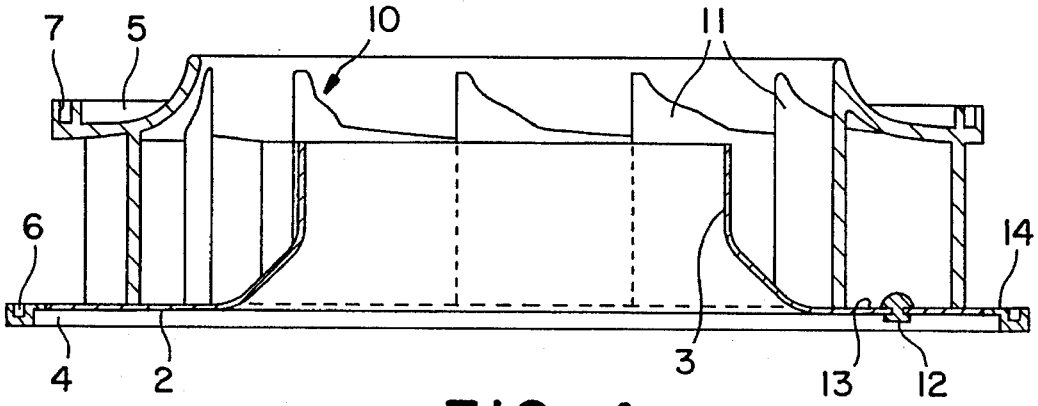
FIG. 4 shows an axial section through the impeller of the fan of FIG. 3.

The plastics injection moulding 1 is constructed in such a way that the two guide rings 4, 5 have different diameters and are arranged in stepped succession. This enables the moulding 1 to be formed in a two-part injection mould without the use of slides and the like. The sheet metal disk 2 is placed within the guide ring 4 and shaped by means of connecting webs 9 onto the outer ends of the blades 11. The inner faces 13 or 14 of the sheet metal disk 2 or the guide ring 4 are aligned with one another, so as not to disturb flow conditions on the impeller 16. FIG. 4 also shows that the sheet metal disk 2 has an inwardly drawn over hub portion 3, which is pressed onto the external rotor of the drive motor 15.

Figure 5:
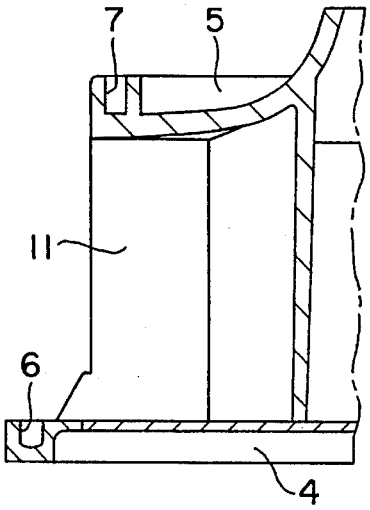
FIG. 5 shows a detail of the impeller of FIG. 4 showing on a larger scale pockets for the insertion of balancing weights.

It can be seen in FIGS. 3 to 5 that both the guide rings 4 and 5 have pockets 6 or 7 formed therein. These pockets 6, 7 open axially. For balancing purposes it is possible to press into these pockets 6, 7 balancing weights, as 8, which weights, for example, may be of lead, and as a result of the configuration of these pockets adequate fixing against centrifugal forces is obtained.

The pockets 6, 7 for receiving the balancing weights 8 are, in the illustrated embodiment, grooved sectors provided on the radially extending, external surfaces of the guide rings 4, 5 and are open axially. The subdivision into grooved sectors increases the stability of the guide rings 4, 5 due to the interposed webs. However, it is also possible to replace the grooved sectors by through grooves or individual bores arranged around the circumference and which are axially open to one side. FIGS. 3 to 5 show that the guide rings 4, 5 have staggered diameters, so that the balancing weights 8 can be inserted from one side without any impediment. This diameter staggering is also appropriate to permit the production of the plastics injection moulding 1 in one piece using a two-part mould.

It is also possible, in the case of the embodiment shown in FIGS. 1 to 5, for the pockets 6, 7 to open to both sides (in the axial direction), so that the balancing weights 8 can be inserted from 8 random side.

Figure 6:
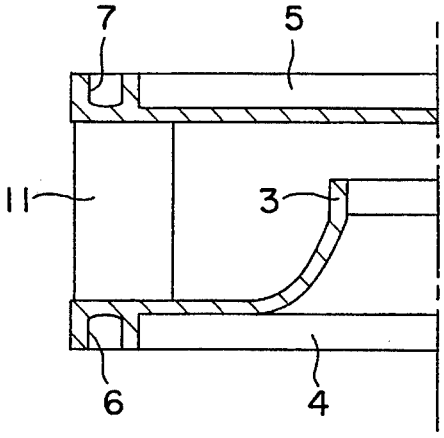
FIG. 6 is a view similar to that of FIG. 5 showing a detail of another embodiment of an impeller.

In a further embodiment of an impeller of the invention, which is illustrated in FIG. 6, the two guide rings 4, 5 have the same diameter and the complete impeller 16 comprising the guide rings 4, 5, the fan blades 11 and the hub portion 8 is injection moulded in plastics material in one piece, for example, with the aid of a slide mould. This impeller has no need for a metal part, such as the sheet metal disk 2.

As shown in FIG. 6, the pockets 6, 7 in the two guide rings 4, 5 open axially in two opposite directions, but the pockets 6, 7 for the insertion of the balancing weights 8 may be open to the same side (in the axial direction) if required. As previously, the pockets may be continuous grooves or bores or interrupted grooves or spaced recesses.

Although the invention has been described and illustrated with respect to a radial fan, it can be used with other fan types. If the fan is, eg an axial blower, then support rings will usually be provided. Such support rings may either carry the fan blades, or, in the case of larger diameter impellers, may be located on the blade tips and interconnect the same. The said support rings may be provided with axially open pockets for the insertion of balancing weights.

It will be appreciated that modifications in or variations of the embodiments as described and illustrated may be made within the scope of the appended claims.

We claim:

1. An impeller for a fan, the impeller having a central axis of rotation, and comprising a hub for engagement with a fan drive rotor, the hub being rotatable by means of said drive rotor about said axis of rotation, a plurality of fan blades supported by said hub for rotation thereby about said axis of rotation, and a support member for said fan blades, said support member extending substantially radially outwardly relative to said hub, wherein the impeller further comprises one or more arcuately shaped pockets formed in said support member and wherein the arcs of the arcuate shape are angularly disposed in a circular path about the axis of rotation of the hub, the pockets each being arranged to open in an axial direction substantially parallel to said axis of rotation, and said pockets being arranged for receiving balance weights.

2. An impeller according to claim 1, wherein the fan is a radial fan, and wherein said support member is a guide ring arranged coaxially of the axis of rotation of said hub and supporting said plurality of fan blades.

3. An impeller according to claim 1, wherein the fan is a radial fan, wherein said support member comprises two axially spaced guide rings, and wherein said blades are arranged in a ring interposed between said guide rings, and wherein at least one of the guide rings is provided with said pockets.

4. An impeller according to claim 3, wherein said guide rings are arranged coaxially to one another and with said axis of rotation, and wherein pockets are provided in each said guide ring.

5. An impeller according to claim 1, wherein said support member comprises two axially spaced guide rings between which said plurality of blades are supported, wherein the two guides rings have substantially the same diameter, and wherein the impeller comprising the guide rings, the fan blades and the hub is injection molded from plastics materials in one piece.

6. An impeller according to claim 5, wherein pockets are provided in both guide rings, these pockets being open to opposite sides.

7. An impeller for a fan comprising a hub for rotation by a drive rotor and a plurality of fan blades for rotation with the hub, the impeller further comprising a support member supporting and connecting said plurality of fan blades, and wherein one or more arcuately shaped pockets are provided in said support member and wherein the arcs of the arcuate shape are angularly disposed in a circular path about the axis of rotation of the hub and opened to face axially of the fan for receiving balance weights, and wherein the pockets are grooves, which open axially.

8. An impeller according to claim 7, wherein said support member comprises two axially spaced guide rings, and said plurality of fan blades are supported between said guide rings, and wherein said two guide rings have different diameters, and wherein diameter staggering takes place towards the open side of the pockets, and the pockets of both guide rings are open axially to the same side.

9. An impeller according to claim 7, wherein said fan blades and said support member are formed as a one-piece plastics moulding, defining two axially spaced guide rings between which said blades are interposed, and wherein said impeller further comprises a sheet metal disk which forms the hub and which is fixed to the plastics moulding by hot crimping.

10. An impeller according to claim 9, wherein pins are located on lateral faces of the blades of said blade ring, and engage in bores of the sheet metal disk, and wherein one of the guide rings is connected to the ends of the blades by connecting webs injection moulded onto the blades.

11. An impeller according to claim 10, wherein the sheet metal disk is placed within the associated guide ring, and the inner face of the metal disk is aligned with the inner face of said guide ring.

12. An impeller according to claim 7, wherein the grooves are continuous and not interrupted.

13. An impeller according to claim 7, wherein the grooves are not continuous, but rather are space apart interrupted segments.

14. An impeller according to claim 7, wherein said support member comprises two axially spaced guide rings, and said plurality of fan blades are supported between said guide rings, and wherein said two guide rings have different diameters, and diameter staggering takes place towards the open side of the pockets, and the pockets of one guide ring are open axially to one side and the pockets on the other guide ring are open axially to another side.

15. A fan incorporating impeller, the impeller having a central axis of rotation, and comprising a hub for engagement with a fan drive rotor, the hub being rotatable by means of said drive rotor about said axis of rotation, a plurality of fan blades supported by said hub for rotation about said axis of rotation, and a support member for said fan blades, said support member extending substantially radially outwardly relative to said hub, wherein the impeller further comprises one or more arcuate shaped pockets formed in said support member, the pockets each having its arc angularly disposed in a circular path about said axis of rotation and being arranged to open in an axial direction substantially parallel to said axis of rotation, and said pockets being arranged for receiving balance weights.

16. A fan incorporating impeller comprising a hub for rotation by a drive rotor and a plurality of fan blades for rotation with the hub, the impeller further comprising a support member supporting and connecting fan blades of said plurality, and wherein one or more pockets are provided in said support member and open to face axially of the fan for receiving balance weights, and wherein the pockets are arcuate grooves angularly disposed in a circular path about the axis of rotation of the hub and, which pockets open axially.

17. An impeller for a radial fan comprising a hub for rotation by a drive rotor and a plurality of fan blades for rotation with the hub, the impeller further comprising support means for supporting such plurality of fan blades, at least one arcuately shaped pocket provided in said support means and wherein the arc of the arcuate shape is annular disposed in a circular path about the axis of rotation of the hub and opened axially of the fan for receiving balance weights, and wherein said support means for said fan blades comprises two axially spaced guide rings between which said plurality of fan blades are supported, and wherein said at least one pocket is provided in at least one of said guide rings.

18. The impeller of claim 17, wherein the pocket is a continuous uninterrupted groove on said guide ring.

19. The impeller of claim 17, wherein the pocket is a plurality of separated grooves segmentally spaced about said guide ring.

20. The impeller of claim 18 where the grooves extend circumferentially about the guide means.

* * * * *

US005591008C1

(12) EX PARTE REEXAMINATION CERTIFICATE (8550th)

United States Patent
Wrobel et al.

(10) Number: US 5,591,008 C1
(45) Certificate Issued: Sep. 20, 2011

(54) FAN IMPELLERS

(75) Inventors: Günter Wrobel, Villingen-Schwenningen (DE); Wolfgang Engel, Königsfeld (DE); Raimund Engelberger, St. Georgen (DE)

(73) Assignee: Papst-Motoren GmbH & Co., KG, St. Georgen (DE)

Reexamination Request:
No. 90/009,546, Jul. 29, 2009

Reexamination Certificate for:

| | |
|---|---|
| Patent No.: | **5,591,008** |
| Issued: | **Jan. 7, 1997** |
| Appl. No.: | **08/459,796** |
| Filed: | **Jun. 2, 1995** |

Related U.S. Application Data

(63) Continuation of application No. 07/787,409, filed on Nov. 4, 1991, now abandoned.

(51) Int. Cl.
*F04D 29/66* (2006.01)

(52) U.S. Cl. ..... 416/144; 416/186 R

(58) Field of Classification Search ..... None
See application file for complete search history.

(56) References Cited

U.S. PATENT DOCUMENTS

| | | | | | |
|---|---|---|---|---|---|
| 2,573,875 | A | * | 11/1951 | Riddiford | 416/207 |
| 2,595,829 | A | * | 5/1952 | Dean | 416/221 |
| 2,842,966 | A | * | 7/1958 | Rued | 73/474 |
| 4,647,271 | A | * | 3/1987 | Nagai et al. | 416/186 R |

* cited by examiner

*Primary Examiner*—Sara Clarke

(57) ABSTRACT

An impeller for a fan comprising a hub for rotation by a drive rotor and a plurality of fan blades for rotation with the hub, the impeller further comprising a support or guide member supporting or connecting fan blades of said plurality, and wherein one or more pockets are provided in said support or guide member and open axially of the fan for receiving balance weights.

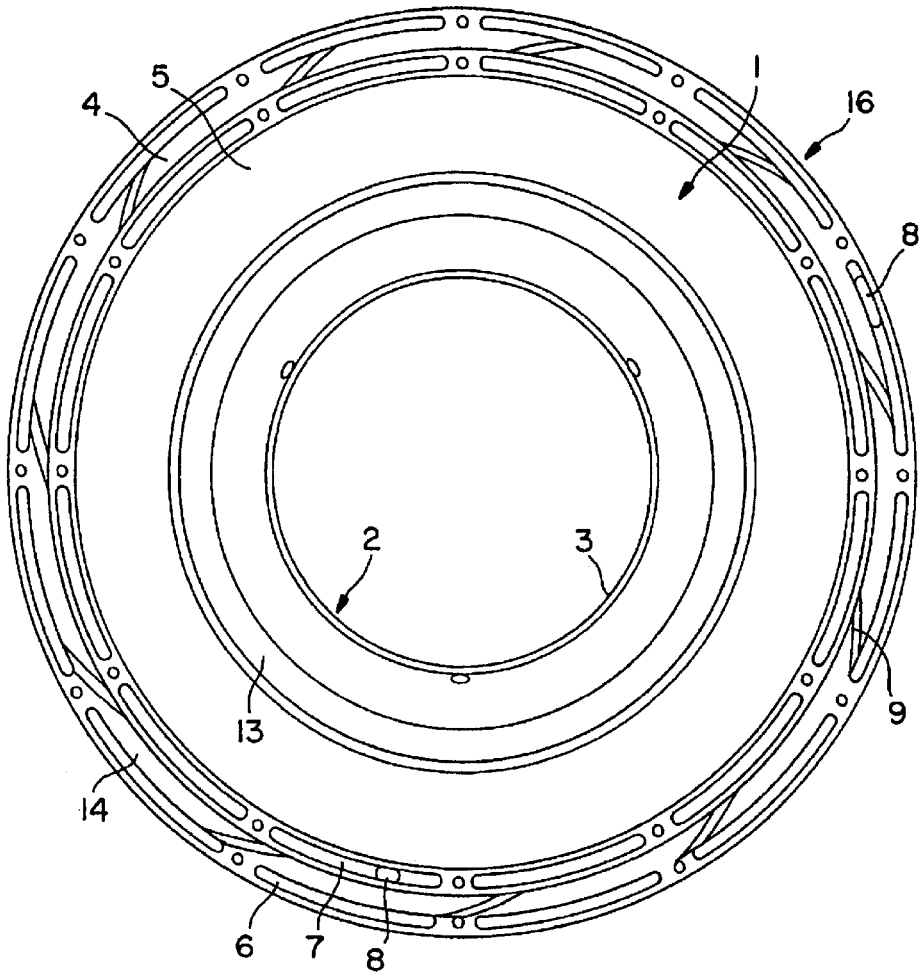

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 7, 9, 15, 16 and 17 are determined to be patentable as amended.

Claims 2-6, 8, 10-14 and 18-20, dependent on an amended claim, are determined to be patentable.

1. An impeller for a fan, the impeller having a central axis of rotation, and comprising a hub for engagement with a fan drive rotor, the hub being rotatable by means of said drive rotor about said axis of rotation, a plurality of fan blades supported by said hub for rotation thereby about said axis of rotation, and a support member for said fan blades, said support member extending substantially radially outwardly relative to said hub, *said fan blades and said support members are formed as a one-piece plastic moulding,* wherein the impeller further comprises one or more arcuately shaped pockets formed in said support member and wherein the arcs of the arcuate shape are angularly disposed in a circular path about the axis of rotation of the hub, the pockets each being arranged to open *to one side* in an axial direction substantially parallel to said axis of rotation, and said pockets being arranged for receiving balance weights.

7. An impeller for a fan comprising a hub for rotation by a drive rotor and a plurality of fan blades for rotation with the hub, the impeller further comprising a support member supporting and connecting said plurality of fan blades, *said fan blades and said support member are formed as a one-piece plastic moulding,* and wherein one or more arcuately shaped pockets are provided in and support member and wherein the arcs of the arcuate shape are angularly disposed in a circular path about the axis of rotation of the hub and opened *to one side* to face axially of the fan for receiving balance weights, and wherein the pockets are grooves, which open axially.

9. An impeller according to claim 7, wherein said [fan blades and said support member are formed as a one-piece] plastics moulding[, defining] *defines* two axially spaced guide rings between which said blades are interposed, and wherein said impeller further comprises a sheet metal disk which forms the hub and which is fixed to the plastics moulding by hot crimping.

15. A fan incorporating impeller, the impeller having a central axis of rotation, and comprising a hub for engagement with a fan drive rotor, the hub being rotatable by means of said drive rotor about said axis of rotation, a plurality of fan blades supported by said hub for rotation about said axis of rotation, and a support member for said fan blades, said support member extending substantially radially outwardly relative to said hub, *said fan blades and said support member are formed as a one-piece plastic moulding,* wherein the impeller further comprises one or more arcuate shaped pockets formed in said support member, the pockets each having its arc angularly disposed in a circular path about said axis of rotation and being arranged to open *to one side* in an axial direction substantially parallel to said axis of rotation, and said pockets being arranged for receiving balance weights.

16. A fan incorporating impeller comprising a hub for rotation by a drive rotor and a plurality of fan blades for rotation with the hub, the impeller further comprising a support member supporting and connecting fan blades of said plurality, *said fan blades and said support member are formed as a one-piece plastic moulding,* and wherein one or more pockets are provided in said support member and open *to one side* to face axially of the fan for receiving balance weights, and wherein the pockets are arcuate grooves angularly disposed in a circular path about the axis of rotation of the hub and, which pockets open axially.

17. An impeller for a radial fan comprising a hub for rotation by a drive rotor and a plurality of fan blades for rotation with the hub, the impeller further comprising support means for supporting such plurality of fan blades, *said fan blades and said support means are formed as a one-piece plastic moulding,* at least one arcuately shaped pocket provided in said support means and wherein the arc of the arcuate shape is annular disposed in a circular path about the axis of rotation of the hub and opened *to one side* axially of the fan for receiving balance weights, and wherein said support means for said fan blades comprises two axially spaced guide rings between which said plurality of fan blades are supported, and wherein said at least one pocket is provided in at least one of said guide rings.

* * * * *